United States Patent [19]

Emmett et al.

[11] Patent Number: 4,482,580

[45] Date of Patent: Nov. 13, 1984

[54] METHOD FOR FORMING MULTILAYERED ELECTROLUMINESCENT DEVICE

[76] Inventors: Manley D. Emmett, P.O. Box 299, Yanceville, N.C. 27379; Robert L. McNellis, 3 S. 216 Cypress, Glen Ellyn, Ill. 60137

[21] Appl. No.: 330,036

[22] Filed: Dec. 14, 1981

[51] Int. Cl.[3] ..... H01J 1/62; B05D 5/12; B05D 3/02

[52] U.S. Cl. ..... 427/66; 313/502; 427/374.1; 427/375

[58] Field of Search ..... 427/66, 374.1, 375

[56] References Cited

U.S. PATENT DOCUMENTS 3,160,541 12/1964 Wollentin ..... 427/375

4,242,370 12/1980 Abdalla et al. ..... 427/66

*Primary Examiner*—John H. Newsome

*Attorney, Agent, or Firm*—Jerome Goldberg

[57] ABSTRACT

A method for forming a multilayered electroluminescent device having dielectric layers sandwiched between two electrodes. One dielectric layer includes phosphor particles dispersed throughout. Each dielectric layer is subjected to three distinct heat levels: a preheat temperature level; a fusing temperature heat level; and a cooling/heat temperature level which enables the contiguous layers to gradually cool into fusion. One electrode may be a solid substrate which is fused to a contiguous dielectric layer and the other electrode substance may be sprayed in a liquid state onto the surface of the phosphor-dielectric layer when it is also in a liquified state after being cooled to the cooling/heat level prior to solidifying. The illuminating phosphors are mixed in the liquified dielectric material just prior to forming the phosphor-dielectric layer and applying the three heat levels thereto.

29 Claims, 3 Drawing Figures

METHOD FOR FORMING MULTILAYERED ELECTROLUMINESCENT DEVICE

BACKGROUND OF THE INVENTION

This invention relates generally to an electroluminescent lamp and more specifically relates to a multilayered electroluminescent lamp having electric field responsive phosphors contained between the two electrodes.

Electroluminescent lamps are generally fabricated by dispersing electric field responsive phosphors in a high dielectric material, which is disposed between a pair of spaced apart electrically conductive surfaces or electrodes. The application of a suitable electrical voltage between the electrodes builds up an electrical field therebetween, creating a capacitive effect in the dielectric layers to activate the electric field responsive phosphors into luminescence.

Electroluminescent lamps having a single dielectric layer between the electrodes, and such single layer containing phosphors embedded therein, have been in extensive use. The problem frequently encountered, which appreciably affected the brightness of the lamp was the dielectric break down or electrical field leakage due to the microscopic voids or pin holes existing or developing in the layer. To overcome this, a second layer or film of dielectric material, such as a non-vitreous low temperature cure plastic dielectric, was applied over the phosphor dielectric layer to plug up the voids. Although the fusing temperature for the second dielectric layer was less than the fusing temperature for the phosphor-dielectric, the phosphor-dielectric layer was subjected to a second heat treatment, which could have an undesirable effect on the illuminating phosphors.

The present invention minimizes the heating of the phosphor-dielectric layer and provides additional dielectric layers to maintain a high dielectric barrier between the electrodes and also to enhance the illuminating quality of the phosphors.

Previous to the subject invention the dielectric layers for the electroluminescent lamps were heated to the fusion temperature and thereafter cooled for fusing one layer with a contiguous layer. During the fusing process, the adjoining layers would distort or warp with respect to each other. The distortion was not sufficiently reduced even when the coeficient of expansion was substantially the same for the adjoining layers. The effect of such distortion was to reduce the overall brightness of the lamp or diminish the light intensity at various points along the lamp and decrease the useful life of the lamp. In the invention herein, as will be more fully described below, the distortion is virtually eliminated by heating the dielectric layers at three distinct temperature levels—a preheat level, a fusion heat level, and a cooling/heat level.

Accordingly, the primary object of the invention is to provide an electroluminescent lamp having substantial brightness from the phosphor particles embedded therein which respond to the electrical field built up between two electrodes. A related object is to provide optimum brightness and long life for the electroluminescent lamp.

Another object is to provide a method for forming a multilayered electroluminescent device which minimizes the distortion or warping between the contiguous surfaces of the layers.

SUMMARY OF THE INVENTION

A multilayered electroluminescent device having at least two dielectric layers disposed between two electrical conducting surfaces or electrodes. One of the dielectric layers includes electric field responsive phosphor particles embedded throughout. The other dielectric layer is positioned between the phosphor-dielectric layer and one of the electrodes to provide a high insulation electrical barrier for minimizing the electrical leakage and also functioning as a background color for enhancing the brightness of the illuminating phosphors.

Each dielectric layer is fused to a contiguous surface by heat treating the device at three temperature levels—preheat level; a fusing heat level; and a cooling/heat level and thereafter solidifying as the device is cooled to room temperature.

The second electrode material, such as a tin oxide which is transparent, is applied in a liquified or mist state to the phosphor-dielectric layer when it is still liquified as it is being cooled after being heated to its fusion temperature. To enable even distribution of the second electrode material, a steam vapor is permeated around the device when the mist is being applied to trap and prevent the escape of the mist particles to the atmosphere.

In order to optimize the brightness of the electroluminescent lamp, phosphor particles are dispersed inside the dielectric material just prior to forming the phosphor-dielectric layer after the other dielectric layer(s) has(have) been formed.

BRIEF DESCRIPTION OF THE DRAWINGS

Referring now to the drawings, in which the same characters of reference are employed to indicate corresponding similar parts throughout the several figures of the drawing.

DESCRIPTION OF THE PREFERRED EMBODIMENT

Figure 1:
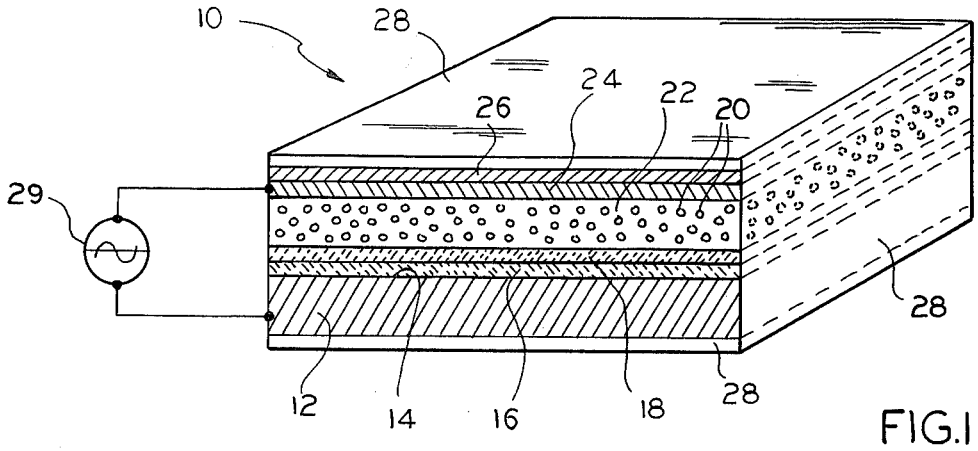
FIG. 1 is a front sectional perspective view of the multilayered electroluminescent lamp.

Referring now to FIG. 1 of the drawing, the reference numeral 10 indicates generally a laminated electroluminescent lamp.

The base or foundation of the lamp 10 is a substrate 12 constructed of a solid, flat and low carbon iron. The size or thickness of the substrate 12 is preferably within the 20 to 28 gauge range. The substrate 12 also functions as the first electrode of the lamp 10. A cleaning substance such as an aluminum oxide may be used to clean the substrate 12. It is desirable that the cleaning operation leave a slightly rough outer or upper surface 14 (as viewed in FIG. 1) inorder to more securely retain the filmed layers of dielectric materials.

A first dielectric film or coating 16 is sprayed on the upper surface 14 of the substrate 12 and fired into fusion with the substrate 12, and thereafter cooled. The first dielectric film 16 is a mixture of frit material and titanium oxide fired into a vitreous enamel or ceramic having a weight of approximately 135 milligrams per square inch.

A second dielectric film or coating 18 is sprayed on the cooled first dielectric film 16, fired into fusion with the first film 16, and thereafter cooled. The second dielectric film 18 is also a mixture of frit material and titanium oxide heated into a vitreous enamel or ceramic. The second film 18, however, includes substantially more of the titanium oxide than the first film 16. The first and second film layers 16, 18 are referred to as ground coats (not electrical ground).

The adding of the titanium oxide to the frit mixture provides a lighter background color for the lamp 10, which affords greater brightness when the lamp 10 is energized for illumination.

The second dielectric film 18 fills or covers any pores or pinholes extending to the surface of the first electrode 12. The two coats of dielectric material ensure proper and desirable insulation between the electrical conducting surfaces.

A liquefied mixture including lead free frit material with an electroluminescent phosphors 20 suspended therein, is sprayed over the first and second dielectric layers 16, 18 to provide a third dielectric layer 22. The layered device 10 is again fired, and prior to the third dielectric layer 22 fusing with the contiguous dielectric layer 18, a mist of tin oxide forming substance is sprayed over the heated dielectric layer 22. The coating of tin oxide is evenly spread over the third layer 22 to function as the second electrode 24 of the electrical system of the lamp 10. The tin oxide may be derived from a tin tetrachloride or stannic chloride solution which is heated upon contact with the heated dielectric layer 22 and solidified into a tin oxide upon cooling of the layered device 10.

The third dielectric layer 22 is a mixture of finely granulated glass powder or frit, free of metallic compounds specifically lead. Metallic materials in the frit produce undesirable opaque qualites by increasing conductivity between electrodes 12 and 24, which may appreciably reduce the brightness of the lamp 10 or may create undesirable dark or shaded areas in the lamp. The fusion or vitrified temperature of the frit must be below the temperature which will damage or appreciably affect the illuminating characteristics of the phosphors 20.

The phosphors 20 are electrically reactive to a build up of electrical field energy between the iron electrode 12 and the tin oxide electrode 24. The phosphors 20 may be a zinc sulfide or a copper activated zinc oxide. The glass frit may be mixed with a solution of hexylene glycol. The phosphors 20 are added to the frit solution and dispersed or suspended throughout. Upon heating, the glycol solution evaporates leaving a vitrified dielectric material dispersed with the phosphors 20.

A silver conductive material 26 is sprayed selectively over areas requiring an even distribution of applied electrical voltage.

For maximum brightness of the lamp 10, the resistance per square inch of the tin oxide electrode 24 is preferably about 5,000 ohms per square inch, but should not exceed 8,000 ohms per square inch.

A clear outer ceramic glaze 28 is sprayed over the layered lamp device 10, except for selective areas to permit electrical contact with the electrodes 12, 24. The sprayed ceramic cover 28 is fired into fusion to envelope the lamp 10.

When alternating current (AC) voltages 29 from 80 to 600 volts AC and frequencies from 60 Hz through 1100 Hz are applied to the electrodes 12 and 24, the lamp 10 provides a uniform light source. This is due to the capacitance between the electrodes 12, 24 creating a sufficient electric field to cause the phosphors to illuminate.

Figure 2:
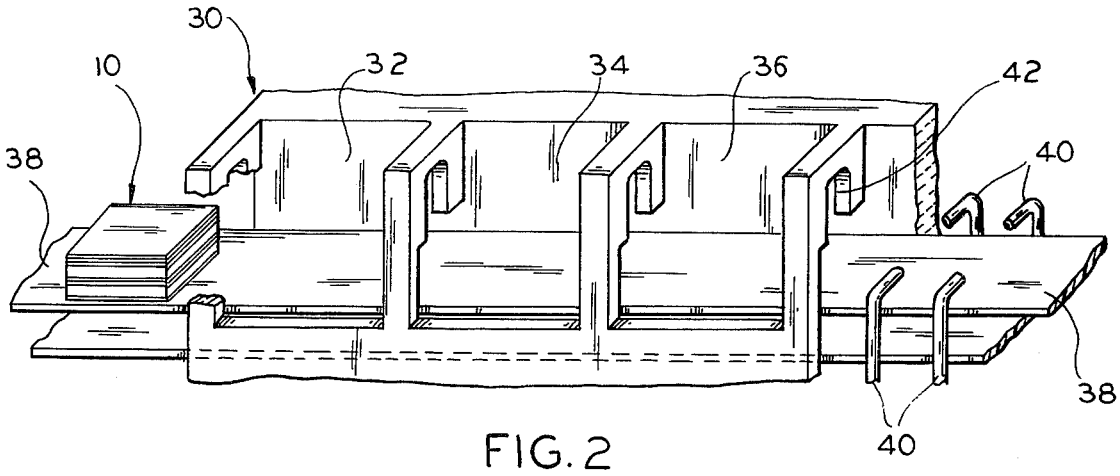
FIG. 2 illustrates the three chambered furnace for heating the layers of the electroluminescent lamp.
Figure 3:
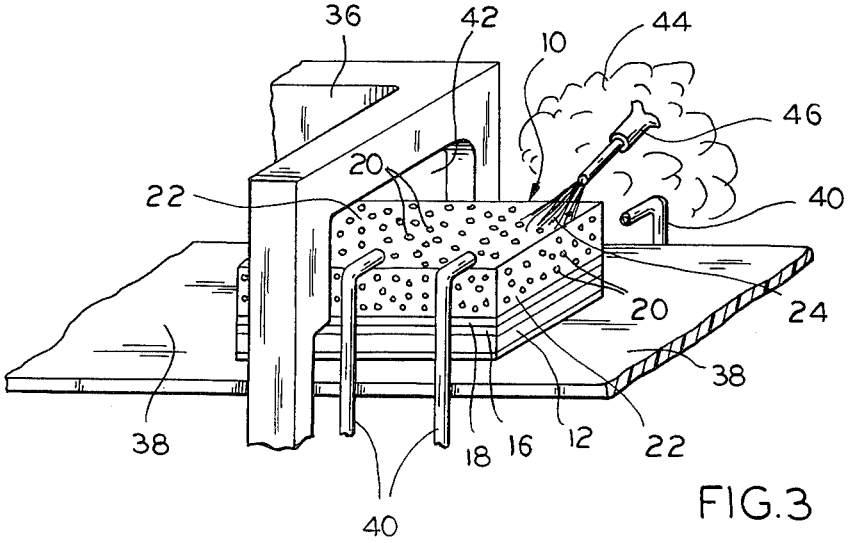
FIG. 3 illustrates the steam vapor permeating around the lamp device when the mist of material for forming the second electrode is applied on the phosphor-dielectric layer.

Referring now more specifically to FIG. 2 of the drawing, the process for fabricating the layered lamp device 10 will be described with greater detail. The firing and fusing of the various layers of the device 10 is achieved by moving the device 10 through a multi-chamber furnace 30. Each chamber is heated to a distinct different temperature level. The furnace 30 includes a first chamber 32, an intermediate chamber 34 and an outer chamber 36.

The intermediate chamber 34 is maintained at a greater temperature level than either the first chamber 32 or the outer chamber 36. The first chamber 32 provides the initial heating of the layers of the lamp 10; the intermediate chamber 34 provides the greatest heat which is necessary for fusing or vitrifying the materials; and the outer chamber 36 is set at a temperature level less than the temperature of the intermediate chamber 34 to commence a gradual cooling of the device 10. Preferably, the cooling temperature of the outer chamber 36 is set greater than the initial heating temperature of the first chamber 32.

In the process for forming the lamp 10, the iron substrate 12 is placed on a continuous moving conveyor belt 38. The substrate 12 is sprayed with the liquified mixture of frit and titanium oxide to provide the film 16 having a weight of approximately one(1) milligram per square inch.

The substrate 12 with the dielectric film layer 16 thereon is conveyed into the first chamber 32 of the multi-chamber furnace 30. The first chamber is set at a temperature of approximately 1300 degrees Fahrenheit to preheat the substrate 12 and the film 14.

From the first or preheat chamber 32, the substrate 12 and the film 14 are conveyed into the intermediate or main heat chamber 34. The main heat chamber 34 is set at approximately 1460 degrees Fahrenheit to heat the substrate 12 and film 14 to their fusing temperature.

From the main heat chamber 34, the substrate 12 and the dielectric film 14 are conveyed into the outer or cooling/heat chamber 36. The outer chamber 36 is set at approximately 1410 degrees Fahrenheit to slowly commence the cooling process.

The conveyor 38 moves through the multi-chambered furnace 30 in approximately 12 minutes, and passing through each chamber in about four minutes.

After leaving the outer or cooling/heat chamber 36, the substrate 12 and ground film 14 are cooled to room temperature, and upon cooling fuse together.

The upper surface of the cooled film 16 is sprayed with the liquified mixture of frit and titanium oxide of a greater amount than the mixture used for the first film 16, to provide the film 18. Preferably, the film 18 is about one half (½) the weight of the film 16.

The substrate 12 with the dielectric film layers 16,18 thereon is conveyed into the first chamber 32 of the multi-chamber furnace 30. The first or preheat chamber 32 is set at a temperature of approximately 1220 degrees Fahrenheit. From the first or preheat chamber 32, the substrate 12 and the film 14 are conveyed into the intermediate or main heat chamber 34.

The main heat chamber 34 is set at a temperature of approximately 1390 degrees Fahrenheit to heat the contiguous film layers 16,18 for fusing the film layers together and plugging up any pores or pinholes in the first dielectric film 16.

From the main heat chamber 34, the substrate 12 and the dielectric films 16,18 are conveyed into the cooling-/heat or outer chamber 36. The outer chamber is set at approximately 1335 degrees Fahrenheit to slowly commence the cooling process. After leaving the outer chamber 36, the layered device 10 is cooled to room temperature and the contiguous layers are fused together.

The mixture of the lead free frit material liquified with the hexylene glycol carrier is prepared. The electroluminescent phosphors 20 are added to the mixture just prior to spraying on the layered device 10, so that the phosphors 20 will be dispersed and suspended throughout the mixture. The phosphors 20 may be added when preparing the liquid frit mixture, but additional phosphors 20 will be added before the third dielectric layer is formed. After the phosphors 20 are added, the third dielectric layer 22 is sprayed on the second dielectric ground coat 18.

The layered device 10 now including the substrate 12 fused to the first dielectric film 16, the second dielectric film 18 fused to the first film 16, and the sprayed layer 22 of the dielectric frit material with the phosphors 20, is conveyed into the preheat chamber 32. The preheat chamber 32 is set at approximately 1140 degrees Fahrenheit to preheat the device 10, particularly the contiguous dielectric film 18.

From the first or preheat chamber 32, the layered device 10 is conveyed into the main heat chamber 34 which is set at approximately 1300 degrees Fahrenheit, to heat the device 10 for fusing the third dielectric layer 22 with the adjacent second ground coat 18.

From the main heat chamber 34, the layered device 10 is conveyed into the cooling/heat chamber 36 to commence the cooling process. The outer chamber 36 is set at approximately 1100 degrees Fahrenheit to slowly commence the cooling process.

One or more steam jets 40 are positioned at or adjacent the exit 42 from the furnace 30, so that a stream of steam is projected upward. The steam permeates around the exit 42, to create a wall of thick vapor 44. When the conveyor 38 with the layered device 10 reaches the exit 42 after the predetermined time duration for remaining inside the outer chamber 36, the third dielectric 22 is still in the melted state and has not solidified. At this time, a mist of the liquified tin oxide is sprayed on the melted dielectric with the gun 46, to form the second electrode 24.

The spray of the tin oxide or tin tetrachloride is evenly distributed over the third dielectric 22, due in part from the temperature control afforded by the steam vapor and the confining force provided by the vapor, to thereby prevent leakage of the spray away from the dielectric surface 22 and into the environment.

The tin oxide electrode 24 is transparent, so that the light brightness generated from the illuminating phosphors is not in any way diluted or decreased.

After the layered device 10 is moved away from the furnace exit 42, the tin oxide electrode 24 and the third dielectric layer 22 solidify and fuse together and the opposite side of the third dielectric solidifies and fuses with the second dielectric film 18 as the device 10 is cooled to room temperature.

The temperature levels given for the furnaces are for purposes of example and may vary with the speed of the conveyor 38 and the thickness of the layers to be fused. However, to avoid damage to the layers of the device 10 the temperature range should be between 950 and 1650 degrees Fahrenheit. In the illustrative embodiment, the temperatures used could be decreased if the speed of the conveyor 38 is decreased (to increase the time duration in the oven from 4 minutes) and the temperature could be increased if the speed of the conveyor 38 is increased (to decrease the time duration in the oven from the 4 minutes).

Although a metal substrate is defined in the embodiment and functions as an electrode, electrically insulative material such as a glass or ceramic may be used for the supportive base of the lamp. A coat or film of tin oxide or other electrically insulative material may be applied on the insulative substrate to provide the necessary electrode to replace the carbon iron substrate 12.

The description of the preferred embodiments of this invention is intended merely as illustrative of the subject invention, the scope and limits of which are set forth in the following claims:

We claim:

1. A process for forming an electroluminescent device including the steps of:

forming an electrical conductive means to provide an electrode for applying electrical voltage;

disposing a layer of dielectric material over said electrode;

inserting the electrode and said dielectric layer into a first furnace having a first heating temperature level;

removing said electrode and dielectric layer after a first predetermined time period;

inserting the electrode and dielectric layer into a second furnace having a second heating temperature level greater than the first temperature level;

removing the electrode and dielectric layer from the second furnace after a second predetermined time period;

inserting the electrode and dielectric layer into a third furnace having a temperature level less than the second temperature level in said second furnace; and cooling the electrode and dielectric layer for fusing the electrode and dielectric layer together.

2. The process of claim 1 wherein the temperature level of said third furnace is greater than the temperature level in said first furnace.

3. The process of claim 1 includes:

disposing a second layer of dielectric material over said first-mentioned layer;

inserting said electrode and said first and second layers into said first furnace having a fourth heating temperature level;

removing said electrode and said first and second layers from said first furnace after a fourth predetermined time period;

inserting said electrode and first and second layers into said second furnace having a fifth temperature level;

removing said electrode and first and second layers from said second furnace after a fifth predetermined time period;

inserting said electrode and said first and second layers into said third furnace having a sixth temperature level;

removing said electrode and said first and second layers from said third furnace after a sixth predetermined time period, said fifth temperature level being greater than said fourth temperature level and said sixth temperature level being less than the fifth temperature level for commencing the cooling of the device; and cooling the electrode and said first and second layers to room temperature for fusing the first and second layers together.

4. The process of claim 3 includes:

disposing a third layer of dielectric material over said second layer;

inserting said device including said three layers of dielectric material and said electrode into said first furnace having a seventh temperature level;

removing said device from said first furnace after a seventh predetermined time period;

inserting said device into said second furnace having an eighth temperature level;

removing said device from said second furnace after an eighth predetermined time period;

inserting said device into said third furnace having a ninth temperature level;

removing said device from said third furnace after a ninth predetermined time period, said eighth temperature level being greater than said seventh temperature level and said ninth temperature level being less than the eighth temperature level; and cooling said device for fusing the second and third layers together.

5. The process of claim 4, wherein said third layer is formed by:

preparing a mixture of frit material combined with an alcohol carrier for liquifying the mixture; and adding electric field responsive phosphors just prior to disposing said third dielectric layer over said second dielectric layer.

6. The process of claim 4 includes:

applying an electrically conductive material on said third dielectric material to provide a second electrode when said third dielectric material is melted and prior to solidifying and fusing with the second layer.

7. The process of claim 6 wherein said conductive material is applied to said third dielectric layer after said ninth predetermined time period.

8. The process of claim 7, wherein said outer furnace has an exit opening leading to the outside;

steam is ejected adjacent said exit on the outside of the furnace prior to applying said second electrode on said thrid dielectric layer, to provide a steam vapor over said third dielectric layer; and cooling said layered device after the second electrode has been applied over said third dielectric, to enable said third dielectric layer to be fused with said second dielectric layer and with said second electrode.

9. The process of claim 6, wherein said electrically conductive material is a mist of tin oxide forming material.

10. The process of claim 6, wherein said electrically conductive material has a resistance less than 8,000 ohms.

11. In a process for forming an electroluminescent device having a pair of electrodes and a plurality of layers of dielectric material between said electrodes, including the steps of:

preparing a mixture of frit material combined with an alcohol carrier for liquifying the mixture; and adding electric field responsive phosphor particles just prior to forming one of said layers of dielectric material having said mixture and the phosphor particles.

12. The process of claim 11 includes:

applying said one layer of dielectric material over another of said dielectric layers; and heating said layers for fusing said dielectric layers together.

13. The process of claim 12, includes:

cooling said heated layers; and applying a second electrode material in a liquified state on said one layer having the phosphor particles when said one layer is cooling but prior to solidifying.

14. The process of claim 13, wherein said second electrode material is a tin oxide.

15. In a process for forming an electroluminescent device having at least a single layer of dielectric material between layers of electrically conductive material including the steps of:

preparing a mixture of dielectric frit material with a liquid carrier and dispersing electrical field sensitive phosphors throughout;

applying said liquified mixture over one of said layers to provide a phosphor-dielectric layer;

heating said liquified mixture for fusing with said one layer of the device when solidifying, said heating evaporating said carrier;

cooling said layers; and applying a liquified electrically conductive material on said phosphor-dielectric prior to said solidifying to provide one of said electrodes, said layers and said electrode being solidified in said device upon said cooling.

16. The process of claim 15, includes:

applying a vapor of steam to said device after said phosphor dielectric layer has been heated but prior to solidifying, said electrode material being applied through said vapor.

17. The process of claim 15, wherein:

said one layer is another dielectric layer.

18. The process of claim 17, wherein said one layer includes titanium oxide to enhance the brightness of said phosphors when illuminating.

19. The process of claim 15, wherein said electrically conductive material is a tin oxide.

20. The process of claim 15, wherein:

said heating includes heating said layers at a first temperature for a predetermined time and heating said layers at a second temperature for a second predetermined time after said first predetermined time, said second temperature being greater than said first temperature.

21. The process of claim 20, wherein said cooling includes heating said layers at a third temperature less than said second temperature for a third predetermined time after said second predetermined time.

22. The process of claim 21, wherein said third temperature is greater than said first temperature.

23. The process of claim 21, wherein said electrode and layers solidify after said third predetermined time and said one electrode is applied after said third predetermined time and prior to said phosphor-dielectric layer solidifying.

24. A process for forming an electroluminescent device having a pair of electrodes with at least one layer of dielectric material therebetween, including the steps of:

dispersing phosphor particles in a dielectric material, said phosphor particles illuminating in response to a voltage being applied across said electrodes;

applying a layer of said phosphor-dielectric mixture on said device;

heating said phospher-dielectric layer for fusing such layer to said device;

cooling said phosphor-dielectric layer for fusing such layer upon solidifying; and applying a layer of electrically conductive material on said phosphor-dielectric layer to form one of said electrodes, when said phosphor-dielectric layer is cooling but prior to solidifying.

25. The process of claim 24, wherein said electrically conductive material applied to said phosphor-dielectric layer is a mist of tin oxide.

26. The process of claim 24, includes:

circulating steam vapor around said device when said electrically conductive material is being applied thereto.

27. A process for forming an electrical device having a pair of electrodes with a layer of dielectric material having electrical field sensitive particles dispersed throughout and disposed between said electrodes including the steps of:

circulating a vapor of steam around said device; and applying a mist of electrically conductive material through said steam and on said device for forming one of said electrodes.

28. The process of claim 27, includes:

heating said device prior to applying said mist for fusing said one electrode to the device.

29. The process of claim 28, wherein said mist is a in oxide.

* * * * *